US011640790B2

(12) United States Patent
Hu et al.

(10) Patent No.: US 11,640,790 B2
(45) Date of Patent: May 2, 2023

(54) PIXEL RENDERING METHOD AND DEVICE, COMPUTER READABLE STORAGE MEDIUM, AND DISPLAY PANEL

(71) Applicants: Chengdu BOE Optoelectronics Technology Co., Ltd., Sichuan (CN); BOE TECHNOLOGY GROUP CO., LTD., Beijing (CN)

(72) Inventors: Yuanzhou Hu, Beijing (CN); Xiaohuan Chang, Beijing (CN); Guoqiang Wu, Beijing (CN); Chenghao Liao, Beijing (CN)

(73) Assignees: Chengdu BOE Optoelectronics Technology Co., Ltd., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/556,133

(22) Filed: Dec. 20, 2021

(65) Prior Publication Data

US 2022/0293053 A1 Sep. 15, 2022

(30) Foreign Application Priority Data

Mar. 10, 2021 (CN) ..... 202110261781.X

(51) Int. Cl.
*G09G 3/3233* (2016.01)

(52) U.S. Cl.
CPC ..... *G09G 3/3233* (2013.01); *G09G 2320/0646* (2013.01); *G09G 2320/0666* (2013.01)

(58) Field of Classification Search
CPC ..... G09G 3/3233; G09G 2320/0646; G09G 2320/0666
See application file for complete search history.

(56) References Cited

U.S. PATENT DOCUMENTS 7,755,649 B2 * 7/2010 Brown Elliott ..... G09G 5/02 345/643
8,203,582 B2 * 6/2012 Elliott ..... G09G 3/3406 345/589

(Continued)

FOREIGN PATENT DOCUMENTS

CN 101452671 A 6/2009
CN 101802698 A 8/2010

(Continued)

OTHER PUBLICATIONS dictionary.com, "adjacent," in dictionary.com Unabridged. Source location: Random House, Inc. http://dictionary.reference.com/browse/adjacent, Nov. 18, 2011, p. 1.*

(Continued)

*Primary Examiner* — Jeff Piziali
(74) *Attorney, Agent, or Firm* — Houtteman Law LLC

(57) ABSTRACT

The present disclosure provides a pixel rendering method, a pixel rendering device, a computer readable storage medium, and a display panel. The method includes: receiving an initial data signal for driving a target sub-pixel to display; determining a data range where the initial data signal is located, where different data ranges correspond to different display modes; determining a weight of color, shared by the target sub-pixel, of a sub-pixel around the target sub-pixel and having the same color as the target sub-pixel according to the data range, where the weight of color is varied in the different display modes; calculating a target data signal of the target sub-pixel according to the weight of color; and outputting the target data signal to the target sub-pixel.

18 Claims, 4 Drawing Sheets

(56) References Cited

U.S. PATENT DOCUMENTS

| | | | | |
|---|---|---|---|---|
| 8,519,910 | B2 * | 8/2013 | Park | G09G 3/2003 345/55 |
| 9,355,587 | B2 * | 5/2016 | Su | G09G 3/2003 |
| 2005/0195418 | A1 * | 9/2005 | Gerrits | H04N 1/54 358/1.9 |
| 2008/0094515 | A1 * | 4/2008 | Gutta | H04N 9/73 348/602 |
| 2010/0182449 | A1 * | 7/2010 | Liao | H04N 9/78 348/222.1 |
| 2010/0207969 | A1 | 8/2010 | Ueki et al. | |
| 2010/0220924 | A1 * | 9/2010 | Lee | G06V 10/56 382/164 |
| 2014/0015865 | A1 | 1/2014 | Kim et al. | |
| 2015/0339827 | A1 * | 11/2015 | Oka | G06T 7/13 382/199 |
| 2016/0035292 | A1 * | 2/2016 | Lee | G09G 3/3648 345/694 |
| 2017/0098432 | A1 * | 4/2017 | Heo | G09G 5/227 |
| 2018/0114476 | A1 * | 4/2018 | Shin | G06T 11/001 |
| 2019/0347973 | A1 | 11/2019 | Chuang | |

FOREIGN PATENT DOCUMENTS

| | | | |
|---|---|---|---|
| CN | 105741720 | A | 7/2016 |
| CN | 106560880 | A | 4/2017 |
| CN | 107979750 | A | 5/2018 |
| CN | 110473488 | A | 11/2019 |
| CN | 111710279 | A | 9/2020 |
| KR | 20060008132 | A | 1/2006 |
| KR | 20140009876 | A | 1/2014 |
| TW | I678687 | B | 12/2019 |

OTHER PUBLICATIONS

China Patent Office, First Office Action dated Nov. 18, 2021, for corresponding Chinese application 202110261781.X.

* cited by examiner

| | | |
|---|---|---|
| $R_{N+3}$ | $R_{N+4}$ | $R_{N+5}$ |
| $R_{N+2}$ | $R_N$ | $R_{N+6}$ |
| $R_{N+1}$ | $R_{N+8}$ | $R_{N+7}$ |

| | | |
|---|---|---|
| $G_{N+3}$ | $G_{N+4}$ | $G_{N+5}$ |
| $G_{N+2}$ | $G_N$ | $G_{N+6}$ |
| $G_{N+1}$ | $G_{N+8}$ | $G_{N+7}$ |

| | | |
|---|---|---|
| $B_{N+3}$ | $B_{N+4}$ | $B_{N+5}$ |
| $B_{N+2}$ | $B_N$ | $B_{N+6}$ |
| $B_{N+1}$ | $B_{N+8}$ | $B_{N+7}$ |

| Display mode | Brightness data range | $\alpha_n$ |
|---|---|---|
| HBM | $(d_9, 4095)$ | $\alpha_{10}$ |
| Normal1 | $(d_8, d_9)$ | $\alpha_9$ |
| Normal2 | $(d_7, d_8)$ | $\alpha_8$ |
| Normal3 | $(d_6, d_7)$ | $\alpha_7$ |
| Normal4 | $(d_5, d_6)$ | $\alpha_6$ |
| Normal5 | $(d_4, d_5)$ | $\alpha_5$ |
| Normal6 | $(d_3, d_4)$ | $\alpha_4$ |
| Normal7 | $(d_2, d_3)$ | $\alpha_3$ |
| Normal8 | $(d_1, d_2)$ | $\alpha_2$ |
| Normal9 | $(0, d_1)$ | $\alpha_1$ |

PIXEL RENDERING METHOD AND DEVICE, COMPUTER READABLE STORAGE MEDIUM, AND DISPLAY PANEL

CROSS-REFERENCE TO RELATED APPLICATIONS

The present application claims the priority of Chinese Patent Application No. 202110261781.X, filed on Mar. 10, 2021, the contents of which are incorporated herein in their entirety by reference.

TECHNICAL FIELD

The present disclosure relates to the field of display technology, and particularly relates to a pixel rendering method, a pixel rendering device, a computer readable storage medium and a display panel.

BACKGROUND

Currently, organic light emitting diode (OLED) display products are increasingly popular.

In the field of OLED displaying, due to limitation of manufactured precision of a fine metal mask (FMM) used in an evaporation process and a demand for a high resolution, a sub-pixel rendering (SPR) technology is applied when an OLED display product displays. In a pixel rendering method of related art, a weight of color, shared by a target sub-pixel, of a sub-pixel around the target sub-pixel and having the same color as the target sub-pixel, is constant under different values of brightness, for example, under display modes with different values of brightness, such as Normal1, Normal2, . . . , Normal9, and HBM (high brightness display mode), the weight of color, shared by the target sub-pixel, of the sub-pixel around the target sub-pixel and having the same color as the target sub-pixel, is constant.

SUMMARY

The present disclosure provides a pixel rendering method, including:

receiving an initial data signal, where the initial data signal is used for driving a target sub-pixel to display;

determining a data range where the initial data signal is located, where different data ranges correspond to different display modes;

determining a weight of color, shared by the target sub-pixel, of a sub-pixel around the target sub-pixel and having the same color as the target sub-pixel, according to the data range where the initial data signal is located, where the weight of color, shared by the target sub-pixel, of the sub-pixel around the target sub-pixel and having the same color as the target sub-pixel is varied in the different display modes;

calculating a target data signal of the target sub-pixel according to the weight of color, shared by the target sub-pixel, of, of the sub-pixel around the target sub-pixel and having the same color as the target sub-pixel; and outputting the target data signal to the target sub-pixel, so that the target sub-pixel displays based on the target data signal.

In some implementations, the determining the data range where the initial data signal is located, includes:

establishing a mapping table between the data ranges and the display modes, where the data ranges correspond to the display modes one by one;

comparing the initial data signal with end values of each data range; and in response to that the initial data signal is greater than or equal to one of the end values of the data range and less than or equal to the other one of the end values of the data range, determining that the initial data signal is within the data range.

In some implementations, the determining the weight of color, shared by the target sub-pixel, of the sub-pixel around the target sub-pixel and having the same color as the target sub-pixel, according to the data range where the initial data signal is located, includes:

establishing a color sharing rule table of sub-pixels of colors in the display modes; and looking for the weight of color, shared by the target sub-pixel, of the sub-pixel around the target sub-pixel and having the same color as the target sub-pixel, in the color sharing rule table according to the data range where the initial data signal is located;

the color sharing rule table stores the weight of color, shared by the target sub-pixel of each color, of the sub-pixel around the target sub-pixel and having the same color as the target sub-pixel in each display mode; and in each display mode, a sum of a weight of color of the target sub-pixel and the weight of color, shared by the target sub-pixel, of the sub-pixel around the target sub-pixel and having the same color as the target sub-pixel equals to 1.

In some implementations, a minimum amount of change in the weight of color, shared by the target sub-pixel of each color, of the sub-pixel around the target sub-pixel and having the same color as the target sub-pixel, in each display mode ranges from 1/8 to 1/64.

In some implementations, the calculating the target data signal of the target sub-pixel according to the weight of color, shared by the target sub-pixel, of the sub-pixel around the target sub-pixel and having the same color as the target sub-pixel, is based on a following formula:

$$I_{out}=\alpha_n\times(W_{cur}\times I_{cur}+W_{ref}\times I_{ref}),$$

where $I_{out}$ indicates the target data signal of the target sub-pixel; $\alpha_n$ indicates a parameter value corresponding to the display mode; $W_{cur}$ indicates a weight of brightness of the initial data signal; $W_{ref}$ indicates a weight of brightness, shared by the target sub-pixel, of the sub-pixel around the target sub-pixel and having the same color as the target sub-pixel; $I_{cur}$ indicates the initial data signal; $I_{ref}$ indicates a data signal of the sub-pixel around the target sub-pixel and having the same color as the target sub-pixel.

In some implementations, the sub-pixel around the target sub-pixel and having the same color as the target sub-pixel is adjacent to the target sub-pixel.

In some implementations, there are three to twelve sub-pixels around the target sub-pixel and having the same color as the target sub-pixel.

In some implementations, a color of the target sub-pixel includes red, green, or blue.

In some implementations, the number of the display modes is ten, a display brightness of the sub-pixel is varied in different display modes, and the data ranges corresponding to the different display modes do not intersect with each other.

The present disclosure further provides a pixel rendering device, including:

a receiving module configured to receive an initial data signal, and the initial data signal is used for driving a target sub-pixel to display;

a first determining module configured to determine a data range where the initial data signal is located, and different data ranges correspond to different display modes;

a second determining module configured to determine a weight of color, shared by the target sub-pixel, of a sub-pixel around the target sub-pixel and having the same color as the target sub-pixel, and the weight of color, shared by the target sub-pixel, of the sub-pixel around the target sub-pixel and having the same color as the target sub-pixel is different in the different display modes;

a calculation module configured to calculate a target data signal of the target sub-pixel according to the weight of color, shared by the target sub-pixel, of the sub-pixel around the target sub-pixel and having the same color as the target sub-pixel; and an output module configured to output the target data signal to the target sub-pixel, so that the target sub-pixel displays based on the target data signal.

In some implementations, the first determining module is configured to:

establish a mapping table between the data ranges and the display modes, where the data ranges correspond to the display modes one by one;

compare the initial data signal with end values of each data range; and in response to that the initial data signal is greater than or equal to one of the end values of the data range and less than or equal to the other one of the end values of the data range, determining that the initial data signal is within the data range.

In some implementations, the second determining module is configured to:

establish a color sharing rule table of sub-pixels of colors in the display modes; and look for the weight of color, shared by the target sub-pixel, of the sub-pixel around the target sub-pixel and having the same color as the target sub-pixel, in the color sharing rule table according to the data range where the initial data signal is located;

the color sharing rule table stores the weight of color, shared by the target sub-pixel of each color, of the sub-pixel around the target sub-pixel and having the same color as the target sub-pixel in each display mode; and in each display mode, a sum of a weight of color of the target sub-pixel and the weight of color, shared by the target sub-pixel, of the sub-pixel around the target sub-pixel and having the same color as the target sub-pixel equals to 1.

In some implementations, the calculation module is configured to calculate the target data signal of the target sub-pixel according to a following formula:

$$I_{out}=\alpha_n\times(W_{cur}\times I_{cur}+W_{ref}\times I_{ref}),$$

where $I_{out}$ indicates the target data signal of the target sub-pixel; $\alpha_n$ indicates a parameter value corresponding to the display mode; $W_{cur}$ indicates a weight of brightness of the initial data signal; $W_{ref}$ indicates a weight of brightness, shared by the target sub-pixel, of the sub-pixel around the target sub-pixel and having the same color as the target sub-pixel; $I_{cur}$ indicates the initial data signal; $I_{ref}$ indicates a data signal of the sub-pixel around the target sub-pixel and having the same color as the target sub-pixel.

The present disclosure further provides a computer readable storage medium having stored thereon a computer program which, when executed by a processor, implements the pixel rendering method described above.

The present disclosure further provides a display panel, which includes sub-pixels arranged in an array, a memory and a processor, where the memory having stored thereon a computer program which, when executed by the processor, implements the pixel rendering method described above.

DESCRIPTION OF EMBODIMENTS

In order to make those skilled in the art better understand the technical solution of the present disclosure, the pixel rendering method, the pixel rendering device, the computer readable storage medium, and the display panel provided in the present disclosure are described in further detail below with reference to the accompanying drawings and the detailed description.

In the related art, the pixel rendering method in which the weight of color, shared by a target sub-pixel, of a sub-pixel around the target sub-pixel and having the same color as the target sub-pixel is constant, causes following problems during displaying of an OLED display product: in a low brightness display mode, a sharpness of a picture displayed under an action of pixel rendering is relatively good, but a relatively serious color cast is caused; in a high brightness display mode, the sharpness of the picture displayed by the action of pixel rendering is relatively poor, but a relatively small color cast is caused. Therefore, it is desirable for an improvement of the pixel rendering method in which the weight of color, shared by a target sub-pixel, of a sub-pixel around the target sub-pixel and having the same color as the target sub-pixel is constant, and a relatively poor sharpness of the picture displayed during high brightness displaying and a relatively serious color cast of the picture displayed during low brightness displaying are caused.

The pixel rendering method, the pixel rendering device, the computer readable storage medium, and the display panel according to embodiments of the present disclosure can solve or improve at least part of the above problems.

Figure 1:
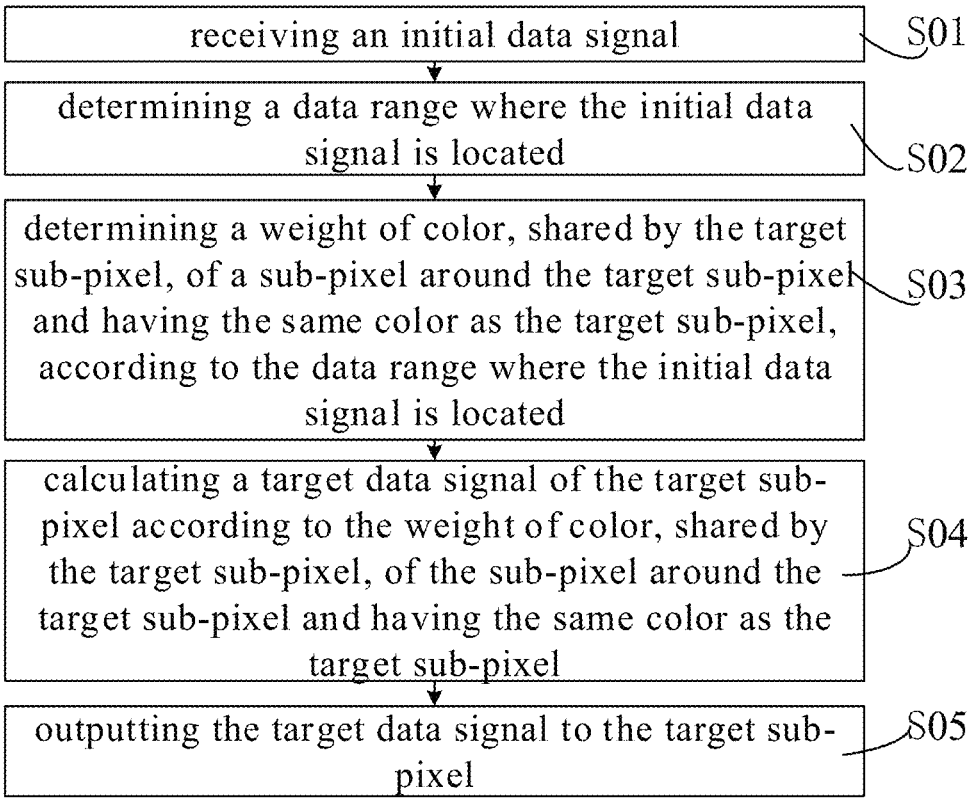
FIG. 1 is a flow chart of a pixel rendering method according to an embodiment of the present disclosure.

An embodiment of the present disclosure provides a pixel rendering method, as shown in FIG. 1, including following steps S01 to S05.

At step S01, receiving an initial data signal, and the initial data signal is used for driving a target sub-pixel to display.

At step S02, determining a data range where the initial data signal is located, where different data ranges correspond to different display modes.

At this step, the data range where the initial data signal is located refers to a brightness data range where the initial data signal is located. Different brightness data ranges correspond to different display modes, that is, display brightness is varied in the different display modes.

At step S03, determining a weight of color, shared by the target sub-pixel, of a sub-pixel around the target sub-pixel and having the same color as the target sub-pixel, according to the data range where the initial data signal is located.

At this step, the weight of color, shared by the target sub-pixel, of the sub-pixel around the target sub-pixel and having the same color as the target sub-pixel, refers to a brightness weight of color, shared by the target sub-pixel, of the sub-pixel around the target sub-pixel and having the same color as the target sub-pixel.

At step S04, calculating a target data signal of the target sub-pixel according to the weight of color, shared by the target sub-pixel, of the sub-pixel around the target sub-pixel and having the same color as the target sub-pixel.

At step S05, outputting the target data signal to the target sub-pixel, so that the target sub-pixel displays based on the target data signal.

In the pixel rendering method, the weight of color, shared by the target sub-pixel, of the sub-pixel around the target sub-pixel and having the same color as the target sub-pixel is determined according to the data range where the initial data signal is located, and can be dynamically adjusted according to a brightness of the target sub-pixel, so that a dynamic color sharing of the sub-pixel is realized, compared with the technical solution of related art in which the weight of color, shared by the target sub-pixel, of the sub-pixel around the target sub-pixel and having the same color as the target sub-pixel is constant for different brightness, a relatively poor sharpness of the picture displayed during high brightness displaying and a relatively serious color cast of the picture displayed during low brightness displaying are improved greatly, the color of the picture displayed would be more delicate, and an improved display effect is obtained.

Figure 2:
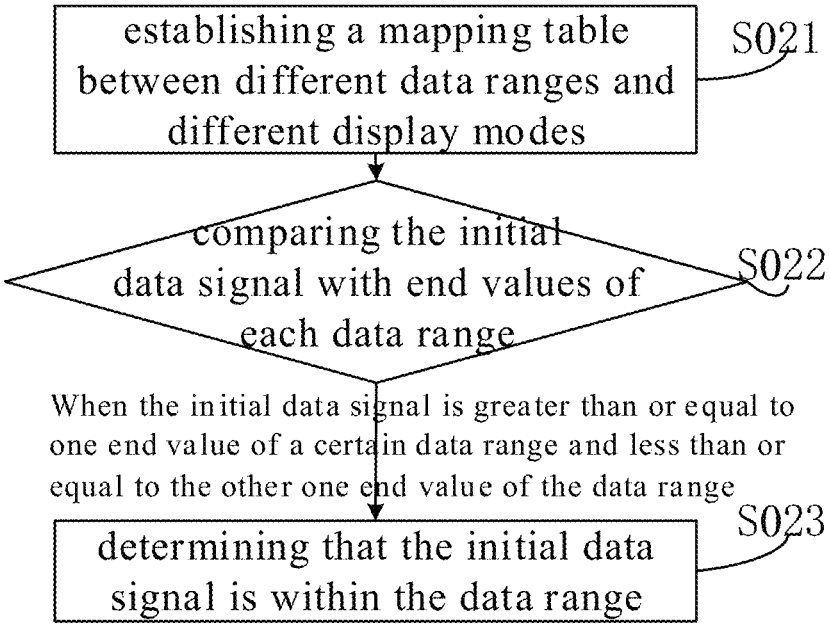
FIG. 2 is a detailed flowchart of step S02 of the pixel rendering method according to an embodiment of the present disclosure.

In some implementations, as shown in FIG. 2, the step S02 (i.e., determining the data range where the initial data signal is located) includes following steps S021 to S023.

At step S021, establishing a mapping table between different data ranges and different display modes, where the different data ranges correspond to the different display modes one by one.

Figures 3, 4:
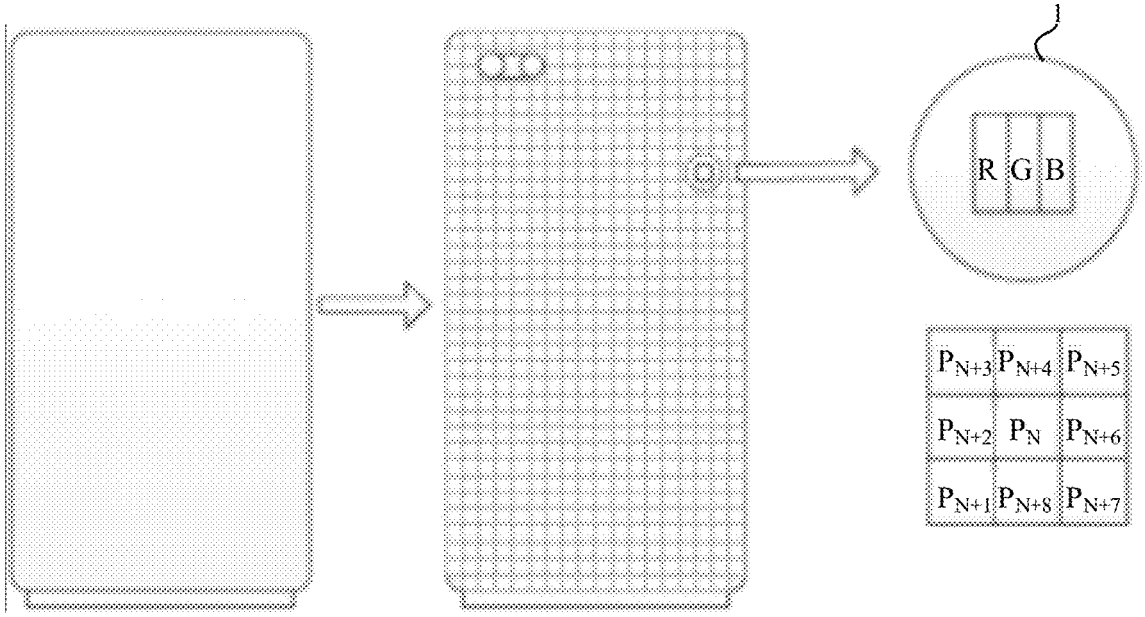
FIG. 3 is a schematic diagram illustrating an arrangement of pixels and sub-pixels of a display panel according to an embodiment of the disclosure.
FIG. 4 is a schematic diagram showing a distribution of sub-pixels of different colors and a distribution of sub-pixels around a target sub-pixel of each color and having the same color as the target sub-pixel according to an embodiment of the present disclosure.

At this step, as shown in FIG. 3, a plurality of pixels 1 are disposed in an organic electroluminescent display panel (i.e., an OLED display panel), each of the pixels 1 is composed of three sub-pixels of red, green and blue, i.e., a color of the target sub-pixel includes red, green or blue, and the sub-pixels are arranged in an array, e.g., in a middle area of the display panel, a sub-pixel $P_N$ of a certain color is surrounded by eight sub-pixels having the same color as the sub-pixel $P_N$, i.e., $P_{N+1}$, $P_{N+2}$, . . . , $P_{N+8}$.

The sub-pixels around the target sub-pixel and having the same color as the target sub-pixel refer to the sub-pixels which surround the target sub-pixel, are adjacent to the target sub-pixel and have the same color as the target sub-pixel. In some implementations, the number of the sub-pixels around the target sub-pixel and having the same color as the target sub-pixel ranges from 3 to 12. That is, according to the arrangement of the pixels in the display panel, in the middle area of the display panel, the number of the sub-pixels around the target sub-pixel and having the same color as the target sub-pixel may range from 4 to 12, and in an edge area of the display panel, the number of the sub-pixels around the target sub-pixel and having the same color as the target sub-pixel may range from 3 to 4. As shown in FIG. 4, in the middle area of the display panel, each red sub-pixel $R_N$ is surrounded by eight red sub-pixels, i.e., $R_{N+1}$, $R_{N+2}$, . . . , $R_{N+8}$; each green sub-pixel $G_N$ is surrounded by eight green sub-pixels, i.e., $G_{N+1}$, $G_{N+2}$, . . . and $G_{N+8}$; and each blue sub-pixel $B_N$ is surrounded by eight blue sub-pixels, i.e., $B_{N+1}$, $B_{N+2}$, . . . , $B_{N+8}$.

Figures 5, 6:
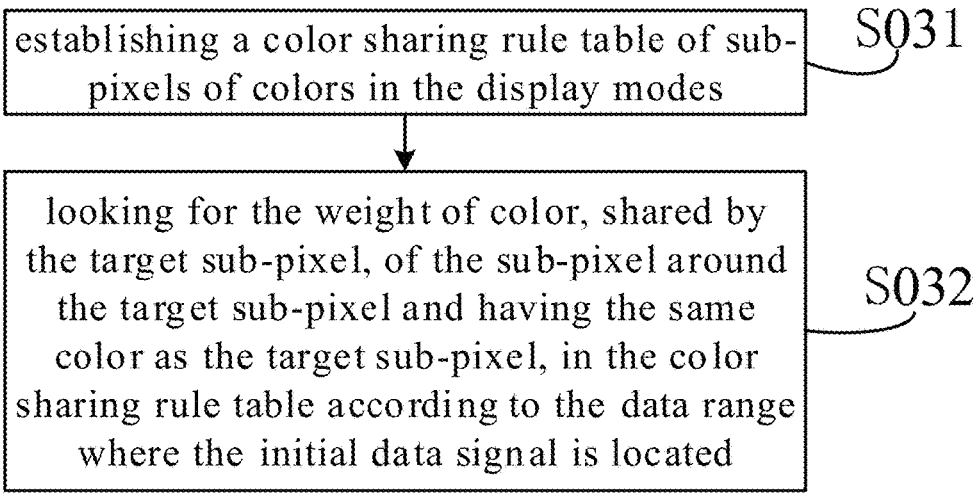
FIG. 5 is a diagram illustrating a correspondence between a display mode and a brightness data range of a display panel and a corresponding parameter value allocated thereto according to an embodiment of the present disclosure.
FIG. 6 is a detailed flowchart of step S03 of the pixel rendering method according to an embodiment of the present disclosure.

In some implementations, the number of the display modes is ten, a display brightness of the sub-pixel is different in different display modes, and the data ranges corresponding to the different display modes do not intersect with each other. For example, the display panel has ten display modes, i.e., Normal9, Normal8, . . . , Normal1, HBM (high brightness mode), the brightness of the ten display modes is successively increased, and brightness data ranges corresponding to the ten display modes are successively increased accordingly. In practical applications, as shown in FIG. 5, a brightness data range of the display panel is within a binary data range from 0 to 4095, the brightness data ranges corresponding to the ten display modes are respectively $0 \leqslant \text{Normal9} \leqslant d_1$, $d_1 \leqslant \text{Normal8} \leqslant d_2$, . . . , $d_8 \leqslant \text{Normal1} \leqslant d_9$, $d_9 \leqslant \text{HBM} \leqslant 4095$.

At step S022, comparing the initial data signal with end values of each data range.

At this step, the initial data signal may be a current value, and corresponds to a corresponding value in a binary data range from 0 to 4095, and then the corresponding value of the initial data signal is compared with end values of the brightness data range in each display mode.

When the initial data signal is greater than or equal to one end value of a certain data range and less than or equal to the other end value of the data range, at step S023, it is determined that the initial data signal is within the data range.

In some implementations, as shown in FIG. 6, the step S03 (i.e., determining the weight of color, shared by the target sub-pixel, of the sub-pixel around the target sub-pixel and having the same color as the target sub-pixel according to the data range where the initial data signal is located) includes steps S031 and S032 as follows.

At step S031, establishing a color sharing rule table of sub-pixels of colors in the display modes.

At step S032, looking for the weight of color, shared by the target sub-pixel, of the sub-pixel around the target sub-pixel and having the same color as the target sub-pixel, in the color sharing rule table according to the data range where the initial data signal is located.

The color sharing rule table stores the weight of color, shared by the target sub-pixel of each color, of the sub-pixel around the target sub-pixel and having the same color as the target sub-pixel in each display mode; and in each display mode, a sum of a weight of color of the target sub-pixel and the weight of color, shared by the target sub-pixel, of the sub-pixel around the target sub-pixel and having the same color as the target sub-pixel equals to 1.

Figure 7:
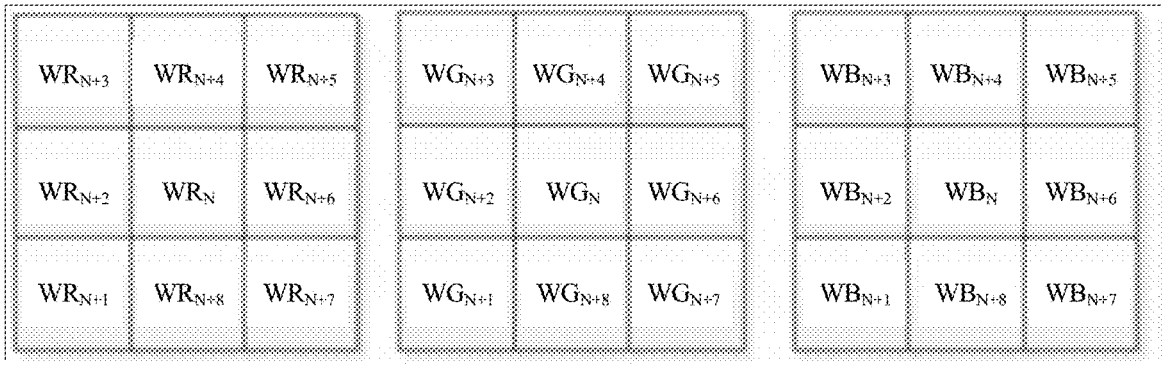
FIG. 7 is a schematic diagram illustrating weights of color, shared by a target sub-pixel of each color, of sub-pixels around the target sub-pixel and having the same color as the target sub-pixel, in different display modes according to an embodiment of the present disclosure.

The weight of color, shared by the target sub-pixel of each color, of the sub-pixel around the target sub-pixel and having the same color as the target sub-pixel in each display mode may have an optimal measured value determined by experiments, and in each display mode, color sharing rule tables for red, green and blue target sub-pixels to share color of sub-pixels around the target sub-pixels and having the same color as the target sub-pixels are independent from each other. As shown in FIG. 7, in each display mode, color sharing rule tables for red, green and blue sub-pixels are respectively provided, the weight of color of a red sub-pixel $R_N$ is $W(R_N)$, weights of color, shared by the red sub-pixel $R_N$, of red sub-pixels, around the red sub-pixel $R_N$, i.e., $R_{N+1}$, $R_{N+2}$, . . . and $R_{N+8}$ are $W(R_{N+1})$, $W(R_{N+2})$ . . . and $W(R_{N+8})$, respectively, and $W(R_N)+W(R_{N+1})+W(R_{N+2})+\ldots+W(R_{N+8})=1$, similarly, the weight of color of a green sub-pixel $G_N$ is $W(G_N)$, weights of color, shared by the green sub-pixel $G_N$, of green sub-pixels, around the green sub-pixel $G_N$, i.e., $G_{N+1}$, $G_{N+2}$, . . . , $G_{N+8}$, are $W(G_{N+1})$, $W(G_{N+2})$, . . . , $W(G_{N+8})$, respectively, and $W(G_{N+1})+W(G_{+2})+\ldots+W(G_{N+8})=1$, the weight of color of a blue sub-pixel $B_N$ is $W(B_N)$, weights of color, shared by the blue sub-pixel $B_N$, of blue sub-pixels, around the blue sub-pixel $B_N$, i.e., $B_{N+1}$, $B_{N+2}$, . . . , $B_{N+8}$, are $W(B_{N+1})$, $W(B_{N+2})$ . . . , $W(B_{N+8})$, respectively, and $W(B_N)+W(B_{N+1})+W(B_{N+2})+\ldots+W(B_{N+8})=1$.

In some implementations, a minimum amount of change in the weight of color, shared by the target sub-pixel of each color, of the sub-pixel around the target sub-pixel and having the same color as the target sub-pixel, in each display mode ranges from 1/8 to 1/64 (3 bits to 6 bits after being converted into binary data). That is, an adjustment of the weight can realize dynamic change from 0 to 1 with the minimum change amount ranging from 1/8 to 1/64, thereby realizing finer adjustment of color of a picture displayed.

In some implementations, the step S04 (i.e., calculating the target data signal of the target sub-pixel according to the weight of color, shared by the target sub-pixel, of the sub-pixel around the target sub-pixel and having the same color as the target sub-pixel) is based on a following formula:

$$I_{out}=\alpha_n\times(W_{cur}\times I_{cur}+W_{ref}\times I_{ref}),$$

where $I_{out}$ indicates the target data signal of the target sub-pixel; $\alpha_n$ indicates a parameter value corresponding to the display mode; $W_{cur}$ indicates a weight of brightness of the initial data signal; $W_{ref}$ indicates a weight of brightness, shared by the target sub-pixel, of the sub-pixel around the target sub-pixel and having the same color as the target sub-pixel; $I_{cur}$ indicates the initial data signal; $I_{ref}$ indicates a data signal of the sub-pixel around the target sub-pixel and having the same color as the target sub-pixel. Weights of brightness, shared by the target sub-pixel, of different sub-pixels around the target sub-pixel may be the same or different, and data signals of the different sub-pixels around the target sub-pixel may be the same or different. The $\alpha_n$ is the corresponding parameter value allocated to the display mode and the brightness data range corresponding to the display mode.

The target data signal of the target sub-pixel calculated according to the above formula is then output to the target sub-pixel to finally drive the target sub-pixel to display, can greatly improve a relatively poor sharpness of the picture displayed during high brightness displaying and a relatively serious color cast of the picture displayed during low brightness displaying, the color of the picture displayed would be more delicate, and an improved display effect is obtained.

Figure 8:
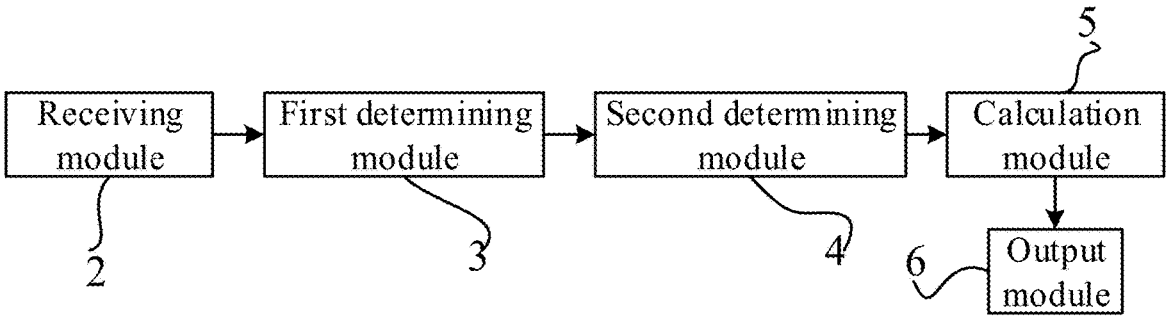
FIG. 8 is a functional block diagram of a pixel rendering device according to an embodiment of the present disclosure.

Based on the pixel rendering method described above, an embodiment of the present disclosure further provides a pixel rendering device, as shown in FIG. 8, including: a receiving module 2 configured to receive an initial data signal, and the initial data signal is used for driving a target sub-pixel to display; a first determining module 3 configured to determine a data range where the initial data signal is located, and different data ranges correspond to different display modes; a second determining module 4 configured to determine a weight of color, shared by the target sub-pixel, of a sub-pixel around the target sub-pixel and having the same color as the target sub-pixel; a calculation module 5 configured to calculate a target data signal of the target sub-pixel according to the weight of color, shared by the target sub-pixel, of the sub-pixel around the target sub-pixel and having the same color as the target sub-pixel; and an output module 6 configured to output the target data signal to the target sub-pixel.

In the pixel rendering device provided in the embodiment of the present disclosure, the weight of color, shared by the target sub-pixel, of the sub-pixel around the target sub-pixel and having the same color as the target sub-pixel is determined according to the data range where the initial data signal is located, and can be dynamically adjusted according to a brightness of the target sub-pixel, so that a dynamic color sharing of the sub-pixel is realized, compared with the technical solution of related art in which the weight of color, shared by the target sub-pixel, of the sub-pixel around the target sub-pixel and having the same color as the target sub-pixel is constant for different brightness, a relatively poor sharpness of the picture displayed during high brightness displaying and a relatively serious color cast of the picture displayed during low brightness displaying are improved greatly, the color of the picture displayed would be more delicate, and an improved display effect is obtained.

An embodiment of the present disclosure further provides a computer readable storage medium on which a computer program is stored, and the computer program, when executed by a processor, implements the pixel rendering method in the above embodiment.

The computer readable storage medium may be a driver chip in the display panel, the driver chip is provided with one or more registers, and the computer program and related data for implementing the pixel rendering method in the above embodiment are stored in the registers.

The computer program may include assembly instructions, instruction set architecture (ISA) instructions, machine instructions, microcode, firmware instructions, state setting data, or source or object code written in any combination of one or more programming languages.

Figure 9:
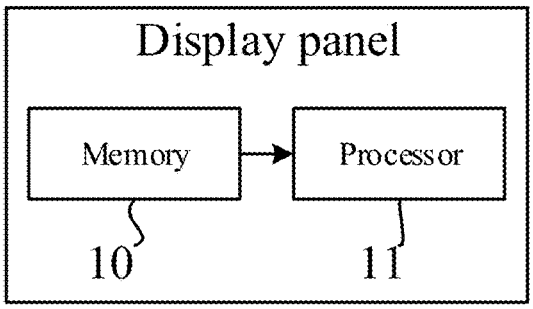
FIG. 9 is a schematic structural diagram of a display panel according to an embodiment of the present disclosure.

An embodiment of the present disclosure further provides a display panel, as shown in FIG. 9, including sub-pixels arranged in an array, a memory 10, and a processor 11, where a computer program is stored on the memory 10, and the computer program, when executed by the processor 11, implements the pixel rendering method according to the foregoing embodiment.

The memory 10 in this embodiment may be the computer readable storage medium in the above embodiment, may be of any type suitable to local technical environments and may be implemented using any suitable data storage technology, such as, but not limited to, a read only memory (ROM), a random access memory (RAM), an optical storage device or system (e.g., digital versatile disc DVD or CD disc), or the like. The computer readable medium may include a non-transitory storage medium. The processor 11 may be of any type suitable to the local technical environments, such as but not limited to general purpose computers, special purpose computers, microprocessors, digital signal processors (DSPs), application specific integrated circuits (ASICs), programmable logic devices (FGPAs), and processors based on a multi-core processor architecture.

When the display panel provided in the embodiment displays a picture with a same gray scale in different display modes, by observing the target sub-pixel through an optical or electrical microscope, it can be observed that the weight of color, shared by the target sub-pixel, of the sub-pixel around the target sub-pixel and having the same color as the target sub-pixel changes along with the change of the display modes.

By implementing the pixel rendering method in the above embodiment, the display panel provided in this embodiment can greatly improve a relatively poor sharpness of the picture displayed during high brightness displaying and a relatively serious color cast of the picture displayed during low brightness displaying, so that the color of the picture displayed by the display panel would be more delicate, and the display effect of the display panel is improved.

The display panel provided in the embodiment may be an OLED display panel, and may be used for any product or component having a display function, such as an OLED television, a display, a mobile phone, and a navigator.

It will be understood that the above embodiments are merely exemplary embodiments employed to illustrate the principles of the present disclosure, and the present disclosure is not limited thereto. It will be apparent to those skilled in the art that various changes and modifications can be made therein without departing from the spirit and scope of the present disclosure, and these changes and modifications are to be considered within the scope of the present disclosure.

The invention claimed is:

1. A pixel rendering method, comprising:

receiving an initial data signal, wherein the initial data signal is used for driving a target sub-pixel to display;

determining a brightness data range where the initial data signal is located, wherein different brightness data ranges correspond to different display modes, and the brightness data ranges corresponding to the different display modes do not intersect with each other;

determining a weight of color, shared by the target sub-pixel, of a sub-pixel for rendering and having the same color as the target sub-pixel, according to the brightness data range where the initial data signal is located, wherein the weight of color, shared by the target sub-pixel, of the sub-pixel for rendering and having the same color as the target sub-pixel is varied in the different display modes;

calculating a target data signal of the target sub-pixel according to the weight of color, shared by the target sub-pixel, of the sub-pixel around the target sub-pixel and having the same color as the target sub-pixel; and outputting the target data signal to the target sub-pixel so that the target sub-pixel displays based on the target data signal.

2. The pixel rendering method of claim 1, wherein the determining the brightness data range where the initial data signal is located comprises:

establishing a mapping table between the brightness data ranges and the display modes, wherein the brightness data ranges correspond to the display modes one by one;

comparing the initial data signal with end values of each of the brightness data ranges; and in response to that the initial data signal is greater than or equal to one of the end values of a certain one of the brightness data ranges and less than or equal to the other one of the end values of the certain one of the brightness data ranges, determining that the initial data signal is within the brightness data range.

3. The pixel rendering method of claim 1, wherein the determining the weight of color, shared by the target sub-pixel, of the sub-pixel for rendering and having the same color as the target sub-pixel, according to the brightness data range where the initial data signal is located, comprises:

establishing a color sharing rule table of sub-pixels of colors in the display modes; and looking for the weight of color, shared by the target sub-pixel, of the sub-pixel for rendering and having the same color as the target sub-pixel, in the color sharing rule table according to the brightness data range where the initial data signal is located, wherein the color sharing rule table stores the weight of color, shared by the target sub-pixel of each color, of the sub-pixel for rendering and having the same color as the target sub-pixel in each display mode; and in each display mode, a sum of a weight of color of the target sub-pixel and the weight of color, shared by the target sub-pixel, of the sub-pixel for rendering and having the same color as the target sub-pixel equals to 1.

4. The pixel rendering method of claim 3, wherein a minimum amount of change in the weight of color, shared by the target sub-pixel of each color, of the sub-pixel for rendering and having the same color as the target sub-pixel, in each display mode ranges from 1/8 to 1/64.

5. The pixel rendering method of claim 1, wherein the calculating the target data signal of the target sub-pixel according to the weight of color, shared by the target sub-pixel, of the sub-pixel for rendering and having the same color as the target sub-pixel, is based on a following formula:

$$I_{out}=\alpha_n\times(W_{Cur}\times I_{cur}+W_{ref}\times I_{ref}),$$

wherein $I_{out}$ indicates the target data signal of the target sub-pixel; $\alpha_n$ indicates a parameter value corresponding to the display mode; $W_{cur}$ indicates a weight of brightness of the initial data signal; $W_{ref}$ indicates a weight of brightness, shared by the target sub-pixel, of the sub-pixel for rendering and having the same color as the target sub-pixel; $I_{cur}$ indicates the initial data signal; $I_{ref}$ indicates a data signal of the sub-pixel for rendering and having the same color as the target sub-pixel.

6. The pixel rendering method of claim 1, wherein there are three to twelve sub-pixels for rendering and having the same color as the target sub-pixel.

7. The pixel rendering method of claim 1, wherein a color of the target sub-pixel comprises red, green, or blue.

8. The pixel rendering method of claim 1, wherein the number of the display modes is ten, a display brightness of the sub-pixel is varied in different display modes.

9. A pixel rendering device, comprising:

a receiving module configured to receive an initial data signal, and the initial data signal is used for driving a target sub-pixel to display;

a first determining module configured to determine a brightness data range where the initial data signal is located, and different brightness data ranges correspond to different display modes, and the brightness data ranges corresponding to the different display modes do not intersect with each other;

a second determining module configured to determine a weight of color, shared by the target sub-pixel for rendering and having the same color as the target sub-pixel, and the weight of color, shared by the target sub-pixel, of the sub-pixel for rendering and having the same color as the target sub-pixel is varied in the different display modes;

a calculation module configured to calculate a target data signal of the target sub-pixel according to the weight of color, shared by the target sub-pixel, of the sub-pixel around the target sub-pixel and having the same color as the target sub-pixel; and an output module configured to output the target data signal to the target sub-pixel, so that the target sub-pixel displays based on the target data signal.

10. The pixel rendering device of claim 9, wherein the first determining module is configured to:

establish a mapping table between the brightness data ranges and the display modes, wherein the brightness data ranges correspond to the display modes one by one;

compare the initial data signal with end values of each brightness data range; and in response to that the initial data signal is greater than or equal to one of the end values of the brightness data range and less than or equal to the other one of the end values of the brightness data range, determining that the initial data signal is within the brightness data range.

11. The pixel rendering device of claim 9, wherein the second determining module is configured to:

establish a color sharing rule table of sub-pixels of colors in the display modes; and look for the weight of color, shared by the target sub-pixel, of the sub-pixel for rendering and having the same color as the target sub-pixel, in the color sharing rule table according to the brightness data range where the initial data signal is located;

the color sharing rule table stores the weight of color, shared by the target sub-pixel of each color, of the sub-pixel for rendering and having the same color as the target sub-pixel in each display mode; and in each display mode, a sum of a weight of color of the target sub-pixel and the weight of color, shared by the target sub-pixel, of the sub-pixel for rendering and having the same color as the target sub-pixel equals to 1.

12. The pixel rendering device of claim 11, wherein a minimum amount of change in the weight of color, shared by the target sub-pixel of each color, of the sub-pixel for rendering and having the same color as the target sub-pixel, in each display mode ranges from 1/8 to 1/64.

13. The pixel rendering device of claim 9, wherein the calculation module is configured to calculate the target data signal of the target sub-pixel according to a following formula:

$$I_{out}=\alpha_n\times(W_{Cur}\times I_{cur}+W_{ref}\times I_{ref}),$$

wherein $I_{out}$ indicates the target data signal of the target sub-pixel; $\alpha_n$ indicates a parameter value corresponding to the display mode; $W_{cur}$ indicates a weight of brightness of the initial data signal; $W_{ref}$ indicates a weight of brightness, shared by the target sub-pixel, of the sub-pixel for rendering and having the same color as the target sub-pixel; $I_{cur}$ indicates the initial data signal; $I_{ref}$ indicates a data signal of the sub-pixel for rendering and having the same color as the target sub-pixel.

14. The pixel rendering device of claim 9, wherein there are three to twelve sub-pixels around the target sub-pixel and having the same color as the target sub-pixel.

15. The pixel rendering device of claim 9, wherein a color of the target sub-pixel comprises red, green, or blue.

16. The pixel rendering device of claim 9, wherein the number of the display modes is ten, a display brightness of the sub-pixel is varied in different display modes.

17. A non-transitory computer readable storage medium, on which a computer program is stored, the computer program, when executed by a processor, implements the pixel rendering method of claim 1.

18. A display panel, comprising sub-pixels arranged in an array, a memory and a processor, the memory storing a computer program which, when executed by the processor, implements the pixel rendering method of claim 1.

* * * * *